US009079702B2

(12) United States Patent
Lahmann et al.

(10) Patent No.: US 9,079,702 B2
(45) Date of Patent: Jul. 14, 2015

(54) CIGAR BOX WITH PEDESTAL LID

(71) Applicant: General Cigar Co., Inc., Glen Allen, VA (US)

(72) Inventors: Ed Lahmann, Richmond, VA (US); Frank Wei-Kuen Liu, Walnut, CA (US)

(73) Assignee: General Cigar Co., Inc., Glen Allen, VA (US)

( * ) Notice: Subject to any disclaimer, the term of this patent is extended or adjusted under 35 U.S.C. 154(b) by 0 days.

(21) Appl. No.: 14/156,984

(22) Filed: Jan. 16, 2014

(65) Prior Publication Data

US 2014/0197055 A1 Jul. 17, 2014

Related U.S. Application Data

(60) Provisional application No. 61/852,460, filed on Mar. 15, 2013, provisional application No. 61/849,100, filed on Jan. 17, 2013.

(51) Int. Cl.

| | |
|---|---|
| ***B65D 43/12*** | (2006.01) |
| ***B65D 85/12*** | (2006.01) |
| ***B65D 51/24*** | (2006.01) |

(52) U.S. Cl.

CPC ..... *B65D 85/12* (2013.01); *B65D 43/12* (2013.01); *B65D 51/249* (2013.01)

(58) Field of Classification Search

CPC ..... B65D 85/12; B65D 43/12; B65D 5/5206; B65D 51/249

USPC ..... 206/45.23, 45.2, 268, 751, 752, 45.22, 206/267; 220/811, 812, 813

See application file for complete search history.

(56) References Cited

U.S. PATENT DOCUMENTS

| | | | | | |
|---|---|---|---|---|---|
| 193,366 | A | * | 7/1877 | Dreyfus | 206/45.2 |
| 1,459,399 | A | * | 6/1923 | Hirsch | 206/45.21 |
| 2,005,816 | A | | 6/1935 | Weiss | |
| 2,131,093 | A | | 9/1938 | Cage | |
| 2,532,083 | A | * | 11/1950 | Brenner | 217/62 |
| 2,860,810 | A | * | 11/1958 | Sargent | 220/351 |
| 2,929,530 | A | * | 3/1960 | Sargent | 220/533 |
| 3,185,293 | A | | 5/1965 | Fletcher | |
| 4,382,504 | A | * | 5/1983 | Vesborg | 206/766 |
| 5,682,182 | A | | 10/1997 | Tsubosaka | |
| 5,732,820 | A | | 3/1998 | Tsai | |
| 5,899,324 | A | | 5/1999 | Stone et al. | |
| 6,157,306 | A | * | 12/2000 | Mularoni | 340/602 |
| 6,182,830 | B1 | | 2/2001 | Au et al. | |
| 6,951,280 | B1 | | 10/2005 | Lee | |
| 7,042,713 | B2 | | 5/2006 | Nicolosi | |
| 7,823,731 | B2 | | 11/2010 | Wu | |
| 2010/0276313 | A1 | * | 11/2010 | Nakano et al. | 206/268 |

* cited by examiner

*Primary Examiner* — Andrew Perreault

(57) ABSTRACT

A cigar box includes a pedestal lid and a base. The base includes front, rear and side panels and a bottom panel. The lid includes a top panel and a front panel. Side edges of the lid are slidably insertable into channels in opposing interior surfaces of the side panels of the base. In a first configuration, the top panel is inserted into the base to close the cigar box. In a second configuration, the lid is removed from the base and placed underneath the bottom panel of the base such that the base is inclined towards its front panel lower. In this configuration, gravity causes cigars within an interior volume of the base to roll downwardly to the front of the base, where an opening in the front panel of the base facilitates their removal.

18 Claims, 11 Drawing Sheets

CIGAR BOX WITH PEDESTAL LID

CROSS-REFERENCES TO RELATED APPLICATIONS

This application claims the benefit of priority under 35 §119(e) to U.S. Provisional Patent Application No. 61/849,100 filed Jan. 17, 2013 and entitled "Cigar box with pedestal lid," and to U.S. Provisional Patent Application No. 61/852,460 filed Mar. 15, 2013 and entitled "Cigar box with pedestal lid." Each of these two provisional patent applications is hereby incorporated by reference in its entirety herein.

TECHNICAL FIELD

The disclosure pertains to cigar boxes, which are used for storing, protecting, transporting, and displaying cigars.

BACKGROUND

Most cigar boxes are constructed and decorated so as to be aesthetically pleasing, and some of them are downright beautiful, so that customer's senses are drawn to the box as well as to the cigars. Some cigar boxes are designed to provide for better display of the box and the cigars they contain. Some cigar boxes are designed with clever and useful functional improvements that make the selection, acquisition, and purchase easier and more interesting, and thus more satisfying. It is all part of the experience.

High quality cigars are often displayed at retail tobacco stores in boxes on shelves in room-size humidors, in order to keep them at the optimum humidity. If the humidity is too low for too long, the cigars will dry out. If the humidity is too high for too long, they will become moldy. The designs of such humidors vary. Some have flat (i.e., level) shelves, while others have inclined shelves that slope toward the customer and terminate in a lip to keep the cigar boxes from falling off. Some have a combination—flat or level lower shelves and inclined upper shelves, so that the user can optimally see and access all the cigars, in the midlevel and higher boxes as well as in the lower boxes. That makes it unnecessary to remove a box from the shelves in order to see the cigars or remove cigars from the box. Of course, cigars are also displayed for retail sale in boxes that are not in humidors, such as in drugstores and restaurants. Display and access is important in this case as well. Such displays are usually on level surfaces.

If there is sufficient shelf space, most conventional rectangular cigar boxes displayed on shelves are displayed as shown for example in FIG. 1. Box 10, which is connected to lid 12 by paper hinge 14, rests on a shelf 11. Box 10 is in a "parallel" position relative to the shelf, with a long side close to the viewer and abutting the lip of the shelf Lid 12 is open, so that the cigars and the graphics on the inner surface of the lid are displayed to the customer. The open lid, being behind box 10, disadvantageously prevents another box from being positioned behind box 10.

If there insufficient shelf space (i.e., too many boxes to be displayed in the parallel position), the boxes are sometimes placed in a "perpendicular" position on the shelves, with a short side closest to the viewer as shown for example in FIG. 2. The problem with perpendicular placement is that lid 12 of box 10 now blocks the adjacent box. To solve this problem, the lid can be torn off the box, as shown in FIG. 3. However, this not only eliminates the functional advantages of the lid, but also sacrifices the attractive graphics which are likely provided on the inside of the lid, and leaves unsightly ragged nubs 16.

Another functional consideration is the humidity retention properties of a closed cigar box which is not in a humidity-controlled environment. A tight air seal is preferable to a more permeable air seal.

SUMMARY

Briefly, aspects of the present disclosure are directed to a cigar box that is configurable in a first configuration for storing, protecting, transporting cigars, and in a second configuration for displaying cigars.

According to aspects of the present disclosure, a cigar box is disclosed having a pedestal lid that is completely removable from the base. The base is formed including five panels with an open top. Two opposing panels among the five panels have horizontal channels running near the tops of their interior surfaces.

The pedestal lid includes a top panel rigidly connected to a front panel. The edges of the top panel are slidably insertable the channels in the base.

In a first, closed configuration, the top panel of the lid closes the box, and the front panel of the lid abuts a front panel of the base. In a second, open configuration, the lid is completely removed, rotated 180 degrees about an axis perpendicular to the top panel and placed beneath the base, so that the base is inclined with its front end lower than its rear end. In this manner, the lid is positioned out of the way so that it does not interfere with the display of the cigars. In the second, open configuration, gravity causes cigars within an interior volume of the base to roll down the incline toward the front of the base, where an opening in the front panel of the base facilitates their removal. Preferably, the top panel of the lid is wholly or partly transparent in order to allow the cigars to be seen when the box is in the closed configuration.

According to other aspects of the present disclosure, the cigar box in the first, closed configuration is effective to protect the cigars enclosed in the interior volume of the base, and in the second, open configuration displays the cigars and enables a customer or retailer to remove one or more of the cigars easily, quickly, gently, and ergonomically.

According to another aspect of the present disclosure, the cigar box also may serve alternate uses after all of the cigars have been dispensed. For example, the cigar box may be used for the storage of small articles such as fasteners and parts. Stored articles can be easily identified for example through the wholly or partly transparent pedestal lid, and the lid can be partially opened to allow the removal of a desired article. This additional use allows the cigar boxes to be recycled and retain value.

This SUMMARY is provided to briefly identify some aspects of the present disclosure that are further described below in the DESCRIPTION. This SUMMARY is not intended to identify key or essential features of the present disclosure nor is it intended to limit the scope of any claims.

The term "aspects" is to be read as "at least one aspect". The aspects described above and other aspects of the present disclosure described herein are illustrated by way of example(s) and not limited in the accompanying drawing.

BRIEF DESCRIPTION OF THE DRAWING

A more complete understanding of the present disclosure may be realized by reference to the accompanying drawing in which.

DESCRIPTION

Figure 1:
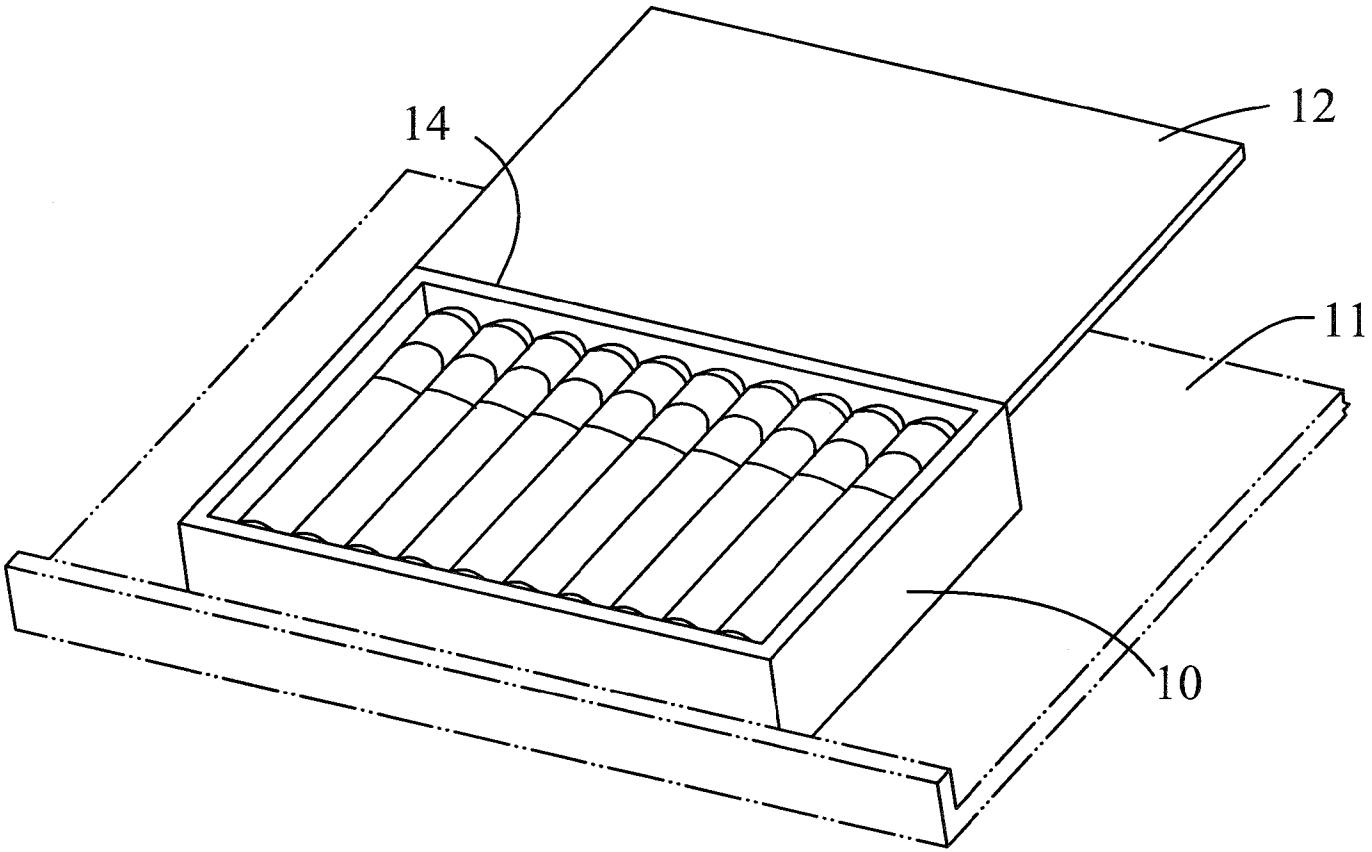
FIG. 1 PRIOR ART
FIG. 1 is a perspective diagram showing a conventional prior art cigar box, with its lid open, resting in a parallel orientation on an inclined shelf.
Figure 2:
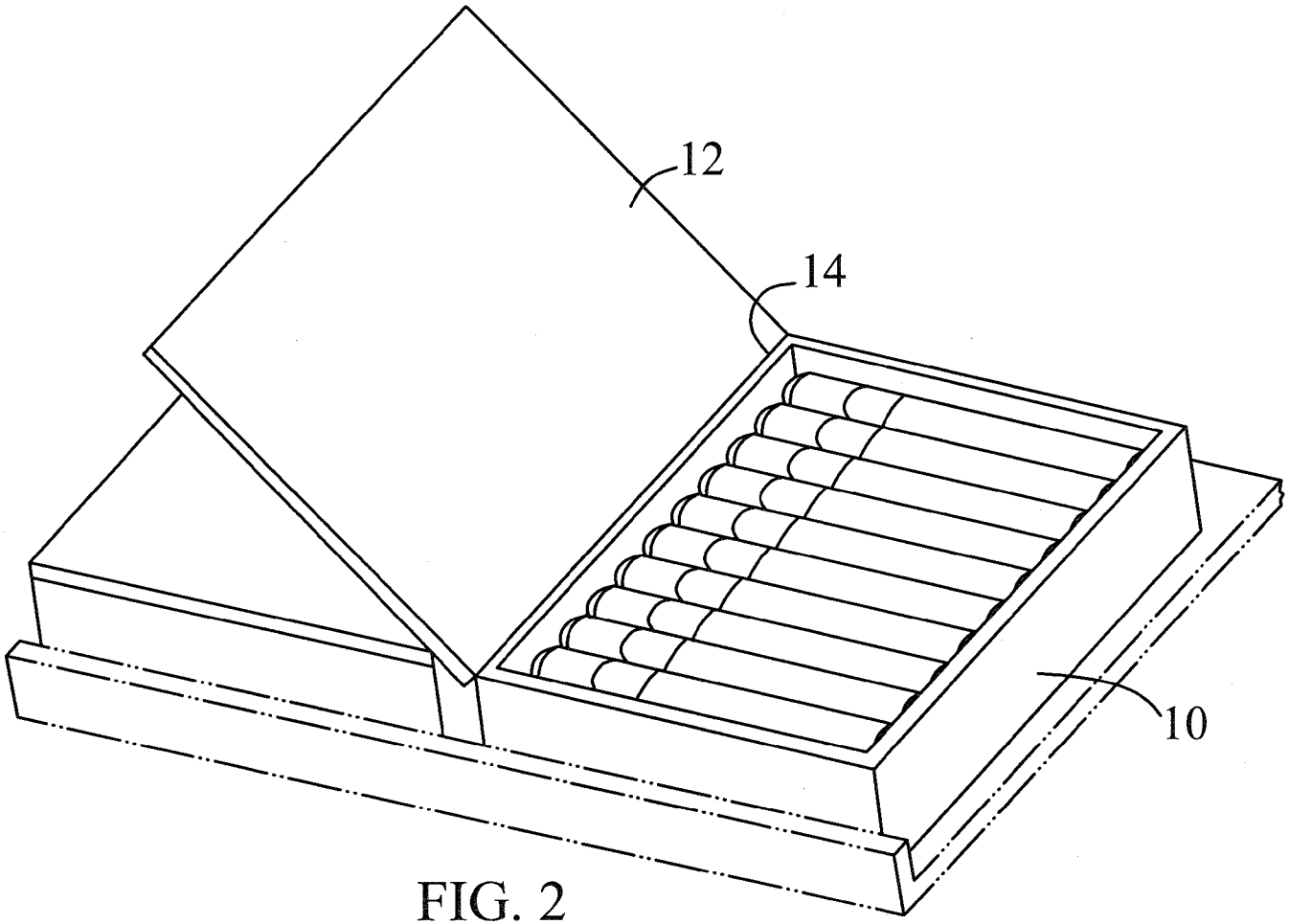
FIG. 2 PRIOR ART
FIG. 2 is a perspective diagram showing two conventional prior art cigar boxes, with one of the lids open, resting in a perpendicular orientation on an inclined shelf.
Figure 3:
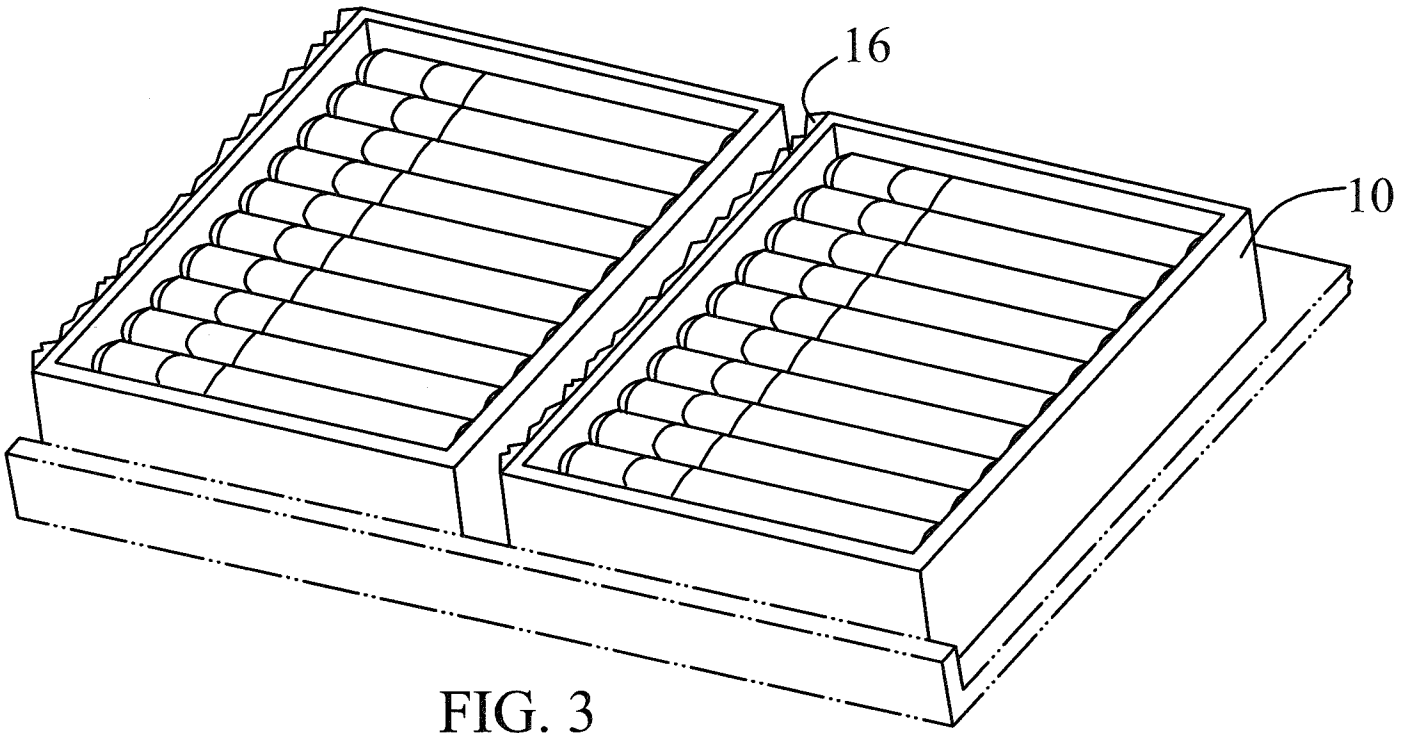
FIG. 3 PRIOR ART
FIG. 3 is a perspective diagram showing two conventional prior art cigar boxes, with the lids of both boxes torn off, resting in a perpendicular orientation on an inclined shelf.
Figure 4:
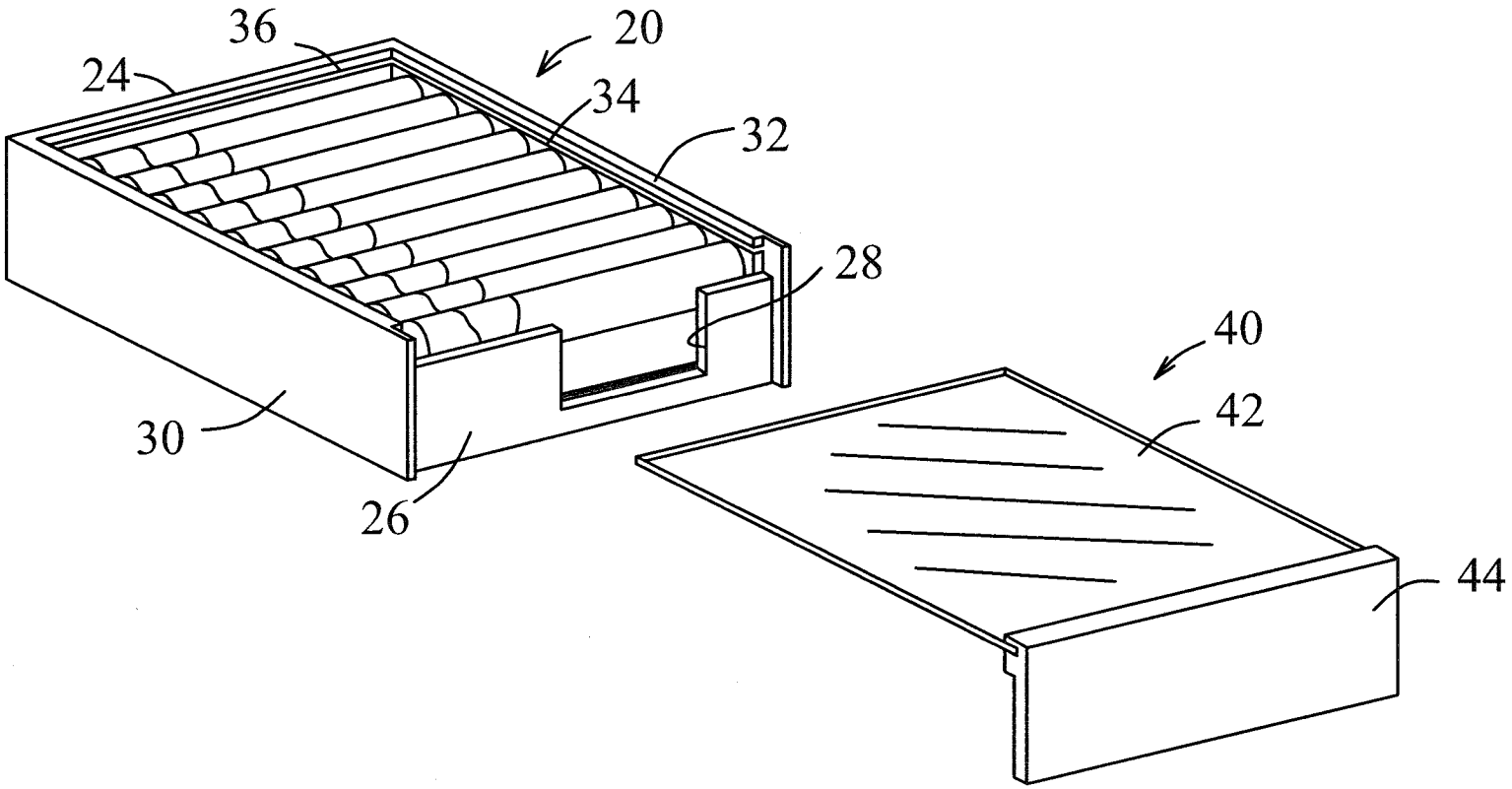
FIG. 4 is a exploded perspective diagram of a cigar box according to aspects of the present disclosure, with a lid of the cigar box removed from a base of the cigar box.
Figure 5:
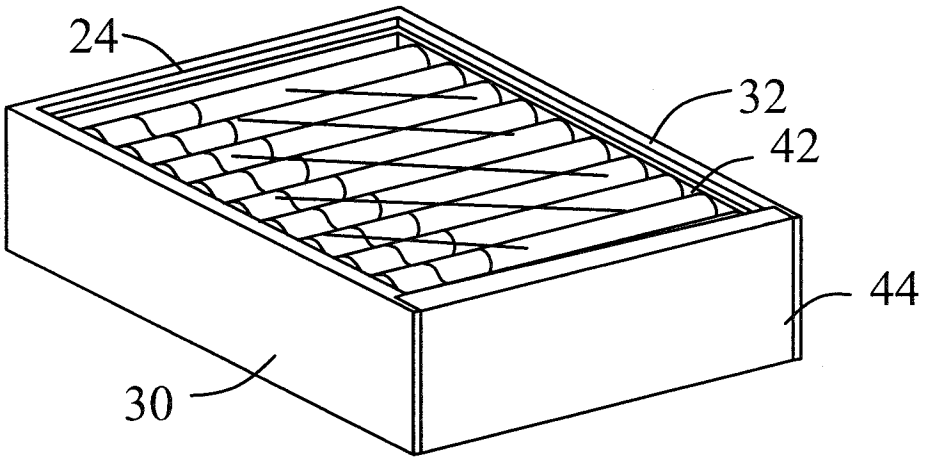
FIG. 5 is a perspective diagram of the cigar box shown in FIG. 4, with the lid attached to the base of the cigar box.
Figure 6:
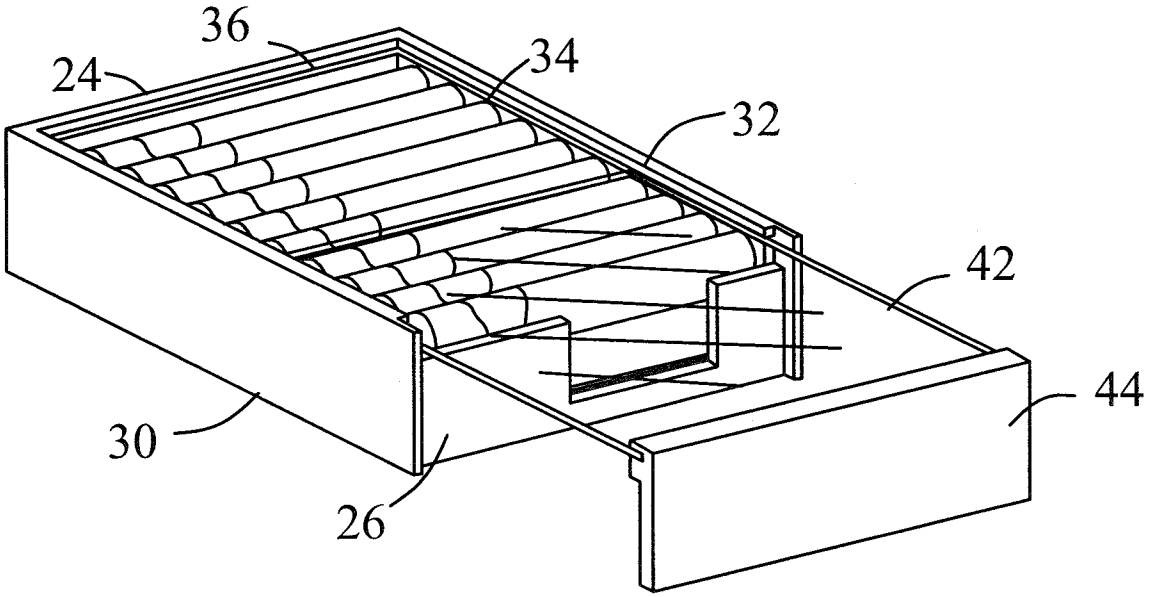
FIG. 6 is a perspective diagram of the cigar box shown in FIG. 4, with the lid partially removed from the base of the cigar box.
Figure 7A:
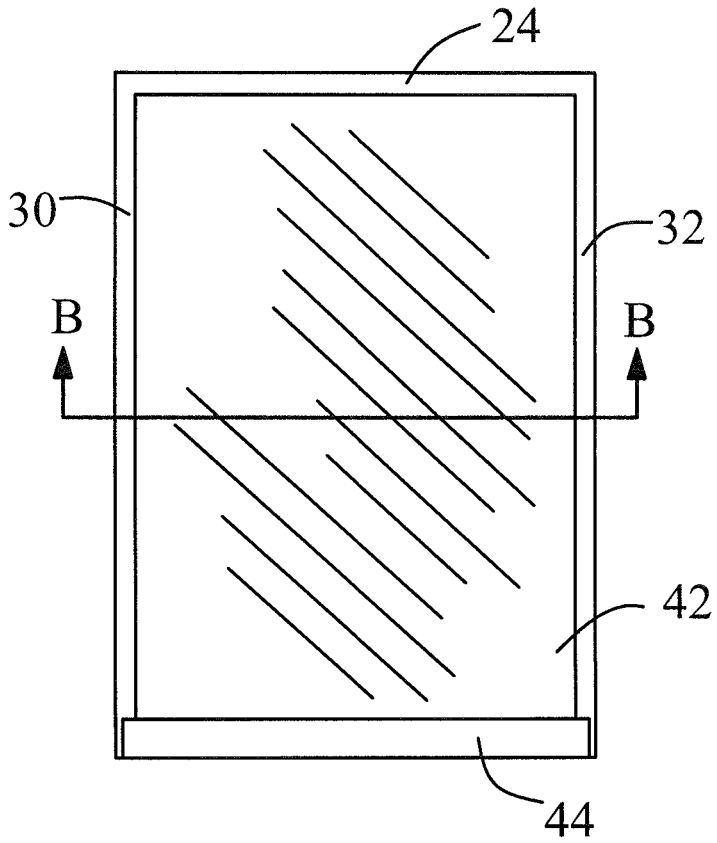
FIG. 7A is a schematic diagram showing a top view of the cigar box shown in FIG. 5.
Figure 7B:
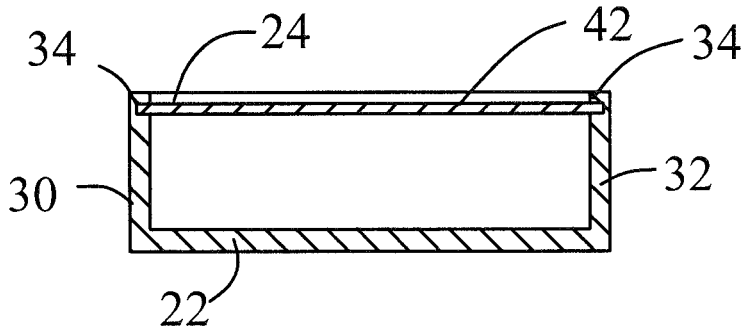
FIG. 7B is a schematic diagram showing a cross-sectional view taken along section B-B in FIG. 7A.
Figure 8:
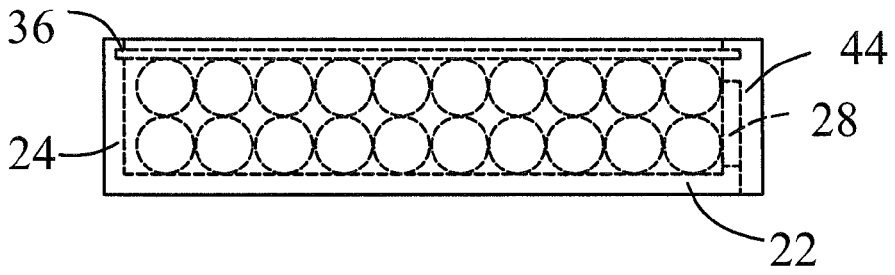
FIG. 8 is a schematic diagram showing a cross-sectional side view of the cigar box shown in FIG. 5.

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Unless otherwise explicitly specified herein, the drawings are not drawn to scale.

We now provide some non-limiting, illustrative examples that illustrate several operational aspects of various arrangements and alternative embodiments of the cigar box presented in the present disclosure.

As used herein, directional terms such as "horizontal" and "vertical" relate to an orientation of the assembled base and lid of the cigar box when the base is positioned on a flat horizontal surface. Similarly, terms such as "front", "rear", "left", and "right" relate to an orientation with respect to a viewer about a central vertical axis of the cigar box. Unless otherwise stated or required by the context, these terms are intended merely to permit the description of aspects of the present disclosure, and not to specify permanent features or characteristics of the cigar box or its orientation during use. The terms "parallel" and "perpendicular" are used to describe, an orientation of a rectangular cigar box on a shelf. In a "parallel" orientation, the long dimension of the box is parallel to the long dimension of the shelf. In a "perpendicular" orientation, the long dimension of the box is perpendicular to the long dimension of the shelf.

Aspects of the present disclosure describe a cigar box used for storing, protecting, transporting, and displaying cigars. As best shown in FIGS. 4-8, a cigar box includes a base 20 and a lid 40. Base 20 includes a bottom panel 22, a rear panel 24, a front panel 26, a left panel 30, and a right panel 32. Front panel 26 is roughly U-shaped, with a large upwardly-facing opening 28 near along a length of the front panel 26. Alternatively, front panel 26 may include two separate pieces defining an opening between them (i.e., a "U" shape with a base defined by the bottom panel). Left panel 30 has a longitudinal channel or groove 34 near the top of an interior surface, as does right panel 32. Grooves 34 in each of the panels 30, 32 face each other. There is a similar groove 36 in an interior surface of rear panel 24. The panels are preferably made of a wood that has an attractive appearance, such as cedar.

Lid 40 includes a top panel 42 and, at its right hand end, a front panel 44. Preferably, these two panels 42, 44 are rigidly and permanently connected to each other to form an "L" shape. Top panel 42 is preferably made of translucent or transparent plastic, which may be etched, frosted, or otherwise decorated. Front panel 44 may preferably be made of wood or plastic.

As best shown in FIGS. 4-6, 7B, and 8, side edges of top panel 42 are slideably engaged by, and ride smoothly in, grooves 34. In the closed configuration of the cigar box shown in FIG. 8, the rear edge of top panel 42 fits into channel or groove 36. In this configuration, a path formed from the interior of the cigar box through the top panel to the ambient atmosphere is U-shaped path, which is considerably more tortuous than the I-shaped path of the base-lid contact of the cigar boxes shown in FIG. 13. The U-shaped path is believed to enhance the moisture-retention properties of the cigar box when it is not in a humidity-controlled environment.

In the closed position, front panel 26 of the base 20 abuts a front panel 44 of the lid 40. Preferably, small button magnets (not shown) are embedded in these surfaces so that they contact each other in the closed position and hold the two panels together. This will keep prevent the lid from falling out of the base when the closed cigar box is being moved. Alternatively, another conventional latching device could also be used for this purpose.

Figure 9:
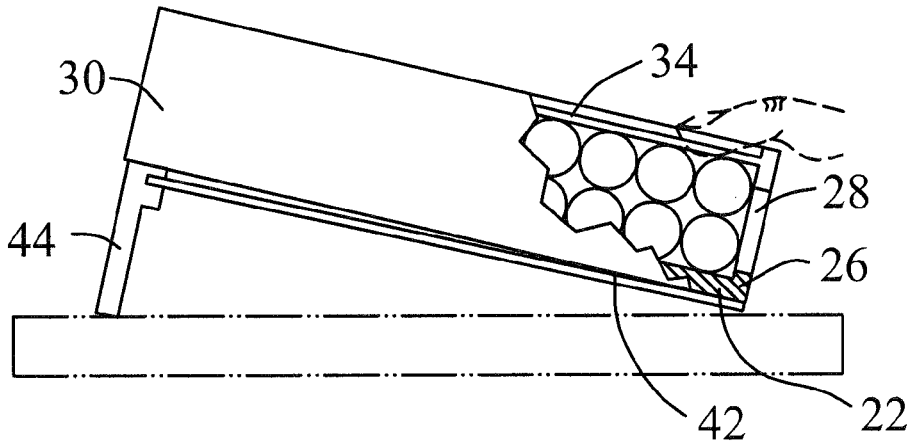
FIG. 9 is a schematic diagram showing a partial cross-sectional side view of the cigar box with the lid removed from the base of the cigar box, rotated 180 degrees and placed under the base on top of a level surface.
Figure 10:
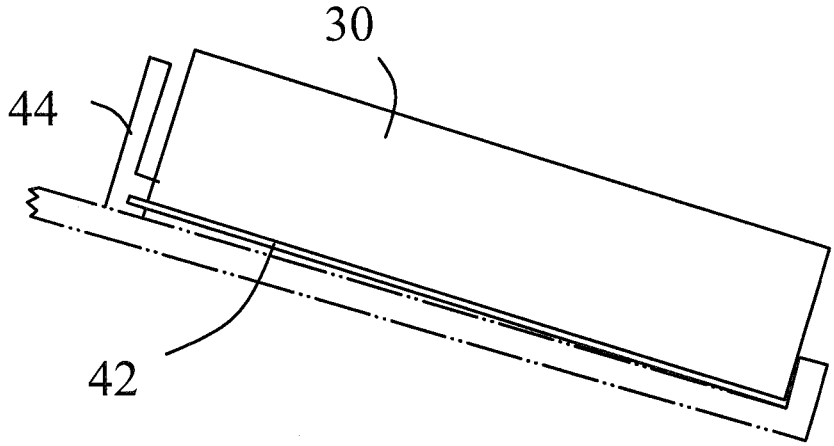
FIG. 10 is a schematic diagram showing a side view of the cigar box with the lid removed from the base of the cigar box, rotated 180 degrees and inverted, and placed under the base on top of an inclined surface.
Figure 11:
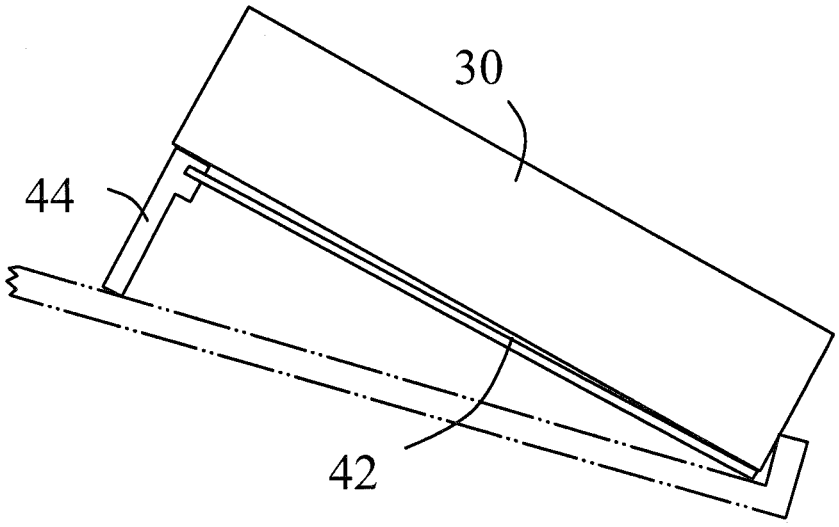
FIG. 11 is a schematic diagram showing a side view of the cigar box with the lid removed from the base of the cigar box, rotated 180 degrees, and placed under the base on top of an inclined surface.

Three alternative display configurations are shown in FIGS. 9-11. In each case, as cigars are removed at the front panel 26 of the base 20, the inclination of the base 20 and the force of gravity cause the remaining cigars to roll toward the front (as depicted in FIGS. 9-11, to the right) to ensure that they abut front panel 26. Opening 28 facilitates their removal by permitting a finger of the customer to "follow through", as best shown in FIG. 9, when removing the top right hand cigar from the box.

In FIGS. 1-3, 10, and 11, the cigar box is shown resting on an inclined surface, while in FIG. 9 the cigar box is shown resting on a level surface. As illustrated, the cigar box provides flexibility in display. For example, in a humidor with only level (i.e., non-inclined) shelves, the configuration of FIG. 10 could be used for lower shelves and the configuration of FIG. 11 used for higher shelves.

Figure 12:
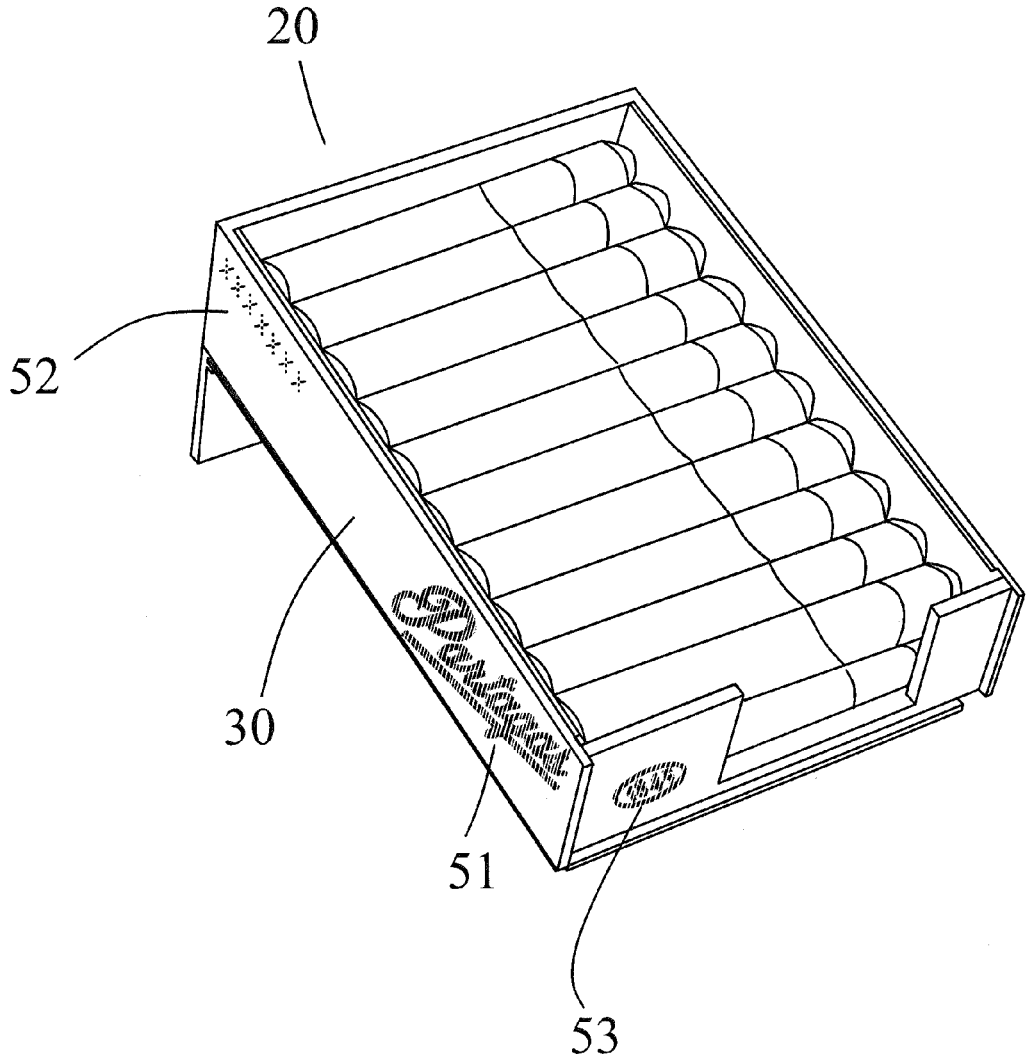
FIG. 12 is a perspective diagram showing the cigar box with the lid removed from the base of the cigar box, rotated 180 degrees and placed under the base.
Figure 13:
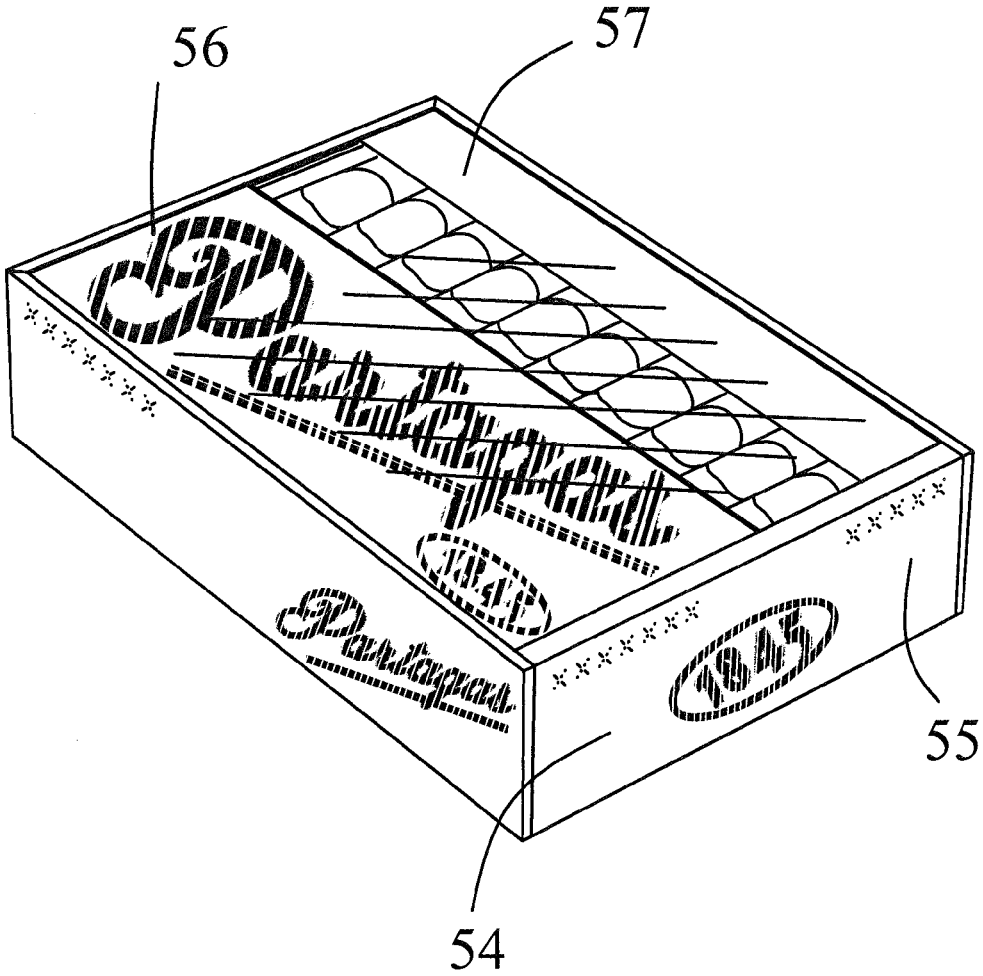
FIG. 13 is a perspective diagram showing the cigar box with the lid attached the base of the cigar box.

In FIGS. 12 and 13, additional aspects of the disclosure are illustrated for each of the open and closed configurations, respectively. In particular, in FIG. 12, decorations 51, 52 are shown applied to left panel 30 of the base 20. In FIG. 13, decorations 54, 55 are applied to the front panel 44 of the lid 40, and decorations 56, 57 are applied to the top panel 42 of the lid 40. As described above, for configurations in which the top panel 42 is formed with a translucent or transparent plastic, the decorations 56, 57 may be preferably formed on a surface of the top panel 42 by conventional etching or frosting methods.

REFERENCE CHARACTER TABLE

The following table lists the reference characters and names of features and elements used herein:

| Ref. char. | Feature or element |
|---|---|
| 10 | base |
| 11 | shelf |
| 12 | lid |
| 14 | hinge |
| 16 | nub |
| 20 | base |
| 22 | bottom panel of base |
| 24 | rear panel of base |
| 26 | front panel of base |
| 28 | opening in front panel |
| 30 | left panel of base |
| 32 | right panel of base |
| 34 | opposed grooves in interior surfaces of left and right panels |
| 36 | groove in interior surface of rear panel |
| 40 | lid |
| 42 | top panel of lid |
| 44 | front panel of lid |
| 51 | decoration at front on left panel of base |
| 52 | decoration at rear on left panel of base |
| 53 | decoration at left on front panel of base |
| 54 | decoration at left on front panel of lid |
| 55 | decoration at right on front panel of lid |
| 56 | decoration at left on top panel of lid |
| 57 | decoration at right on top panel of lid |

It will be understood that, while presently preferred embodiments of the invention have been illustrated and described, the invention is not limited thereto, but may be otherwise variously embodied within the scope of the following claims.

The invention claimed is:

1. A cigar box having the shape of a rectangular prism and the cigar box comprising:

a base having a horizontal bottom panel, a vertical rear panel, a vertical front panel, and two vertical side panels, wherein the vertical rear panel, vertical front panel and vertical side panels extend upwardly from the horizontal bottom panel, wherein a top of each side panel has a horizontal, inwardly facing channel running along the top of each side panel's length of each side panel's in proximity to a top edge of the side panel so that the two channels oppose each other, wherein the vertical front panel is inwardly recessed with respect to front edges of the vertical side panels, and wherein a top edge of the vertical front panel terminates below the inwardly facing channels of the vertical side panels; and a removable lid having a horizontal top panel and a vertical front panel rigidly connected to and extending downwardly from the top panel, which top panel is dimensioned so that side edges of the top panel fit slideably into the channels of the base;

the cigar box being configurable back and forth to a first, closed position in which the box is arranged to enclose and protect cigars during storage, transport, and handling, and to a second, open position in which the box is arranged to display the enclosed cigars in an open format to facilitate their removal by a consumer;

whereby, in the first position the horizontal top panel covers the top of the base, with the top panel's side edges in the channels and the front panel of the lid against the inwardly-recessed front panel of the base, such that an outer surface of the vertical front panel of the removable lid is flush with the front edges of the vertical side panels, the removable lid and the base thereby configured to fully enclose cigars in the box; and whereby, in the second position the lid is removed from the channels and placed under the base, with the bottom panel of the base resting on the top panel of the lid and the front panel of the lid disposed under the rear panel of the base, thereby elevating the rear of the base, lowering the front panel of the base, and inclining the box so that gravity causes the cigars to roll toward the lowered front panel of the base and providing access in proximity to the lowered front panel for removing cigars from an interior volume of the cigar box.

2. The cigar box according to claim 1 wherein the front panel of the base has an opening which, in the second, open position, facilitates the removal of a cigar by a finger of the user.

3. The cigar box according to claim 1 wherein the channels are grooves in the interior surfaces of the side panels.

4. The cigar box according to claim 1 wherein, when the box is in the first, closed position, the top of the rear panel has a horizontal, inwardly facing groove running along its length and the rear edge of the top panel fits into that channel.

5. The cigar box according to claim 1 wherein the top panel is transparent.

6. A cigar box comprising a base having a horizontal bottom panel, a vertical rear panel, a vertical front panel, and two vertical side panels, wherein the vertical rear panel, vertical front panel and vertical side panels extend upwardly from the horizontal bottom panel, wherein the vertical front panel is inwardly recessed with respect to front edges of the vertical side panels, and wherein a top edge of the vertical front panel terminates below top edges of the vertical side panels; and a removable lid having a horizontal top panel and a vertical front panel connected and extending downwardly from to the top panel, wherein:

the cigar box is configurable in each of a first, closed position suitable for storing, transporting or handling the cigar box, and a second, open position suitable for displaying the cigar box on a display surface;

in the first, closed position, the horizontal top panel is secured to the base and the front panel of the lid abuts the inwardly-recessed front panel of the base, such that an outer surface of the vertical front panel of the removable lid is flush with the front edges of the vertical side panels, and the horizontal top panel in combination with the base are configured to fully enclose an interior volume of the box; and whereby, in the first position the horizontal top panel covers the top of the base, with the top panel's side edges in channels of the vertical side panels of the base and the front panel of the lid against the inwardly-recessed front panel of the base, such that an outer surface of the vertical front panel of the removable lid is flush with the front edges of the vertical side panels and horizontal bottom panel, the removable lid and the base thereby configured to fully enclose cigars in the box; and in the second, open position, the lid is detachably removed from the base and placed under the bottom panel of the base, such that the bottom panel of the base rests on the top panel of the lid and the front panel of the lid is disposed under the rear panel of the base, thereby elevating a rear edge of the base, lowering a front edge of the base and inclining the base relative the display surface so that the base provides access in proximity to the lowered front edge of the base for removing cigars from the interior volume.

7. The cigar box of claim 6, wherein the front panel of the base includes an upwardly facing opening configured to provide access for removing cigars from the interior volume.

8. The cigar box of claim 6, wherein each side panel further comprises a horizontal, inwardly facing channel running lengthwise along the panel in proximity to a top edge, the inwardly facing channels being positioned in opposition to one another and dimensioned for slideably receiving side edges of the top panel for securing the top panel to the base in the first, closed position.

9. The cigar box of claim 8, wherein the rear panel further comprises an inwardly facing channel running lengthwise along the panel in proximity to a top edge, the inwardly facing channel being positioned and dimensioned for receiving a rear edge of the top panel of the lid in the first, closed position.

10. The cigar box of claim 8, further comprising a retainer for retaining the front panel of the base in abutment with the front panel of the lid in the first, closed position.

11. The cigar box of claim 10, wherein the retainer comprises magnets affixed in proximity to opposing surfaces of each of the font panel of the base and the front panel of the lid, the magnets being positioned to draw the opposing surfaces of the front panel of the base and the front panel of the lid together in the first, closed position.

12. The cigar box of claim 6, wherein the top panel and front panel of the removable lid are rigidly connected to form an L-shape.

13. The cigar box of claim 6, wherein the top panel of the removable lid comprises a first material and the front panel of the removable lid comprises a second material.

14. The cigar box of claim 13, wherein the first material comprises a transparent or translucent plastic and the second material comprises a plastic or a wood.

15. The cigar box of claim 14, wherein top panel of the lid is partly transparent.

16. The cigar box of claim 14, wherein the transparent or translucent plastic comprises an etched or frosted pattern.

17. The cigar box of claim 6, wherein the removable lid is inverted in the second, open position to achieve an alternate elevation of the base relative to the display surface.

18. The cigar box of claim 6, wherein surfaces of the bottom panel of the base and the top panel of the lid resting on one another in the second, open position are substantially coextensive.

* * * * *